US005692571A

United States Patent [19]

Jackson

[11] Patent Number: 5,692,571

[45] Date of Patent: Dec. 2, 1997

[54] BUILDING EXTERIOR FIRE PREVENTION SYSTEM

[76] Inventor: Willie C. Jackson, 24808 Mission Blvd., Hayward, Calif. 94545

[21] Appl. No.: 754,792

[22] Filed: Nov. 21, 1996

[51] Int. Cl.[6] ..... A62C 3/00

[52] U.S. Cl. ..... 169/16; 169/23

[58] Field of Search ..... 169/16, 23; 239/201

[56] References Cited

U.S. PATENT DOCUMENTS

| | | | |
|---|---|---|---|
| 1,492,941 | 5/1924 | Sherman et al. | 239/201 |
| 1,893,210 | 1/1933 | Rider | 239/201 |
| 3,650,478 | 3/1972 | Jones | 239/201 |
| 4,330,040 | 5/1982 | Ence et al. | 169/16 |
| 5,165,482 | 11/1992 | Smagac et al. | 169/16 |

FOREIGN PATENT DOCUMENTS

| | | | |
|---|---|---|---|
| 283013 | 8/1966 | Australia | 169/23 |
| 2672222 A | 8/1992 | France | 169/16 |

OTHER PUBLICATIONS

"Many Functions Performed by Automatic Alarm," Popular Mechanics, pe 913 Jun. 1916.

*Primary Examiner*—Gary C. Hoge

[57] ABSTRACT

A new Building Exterior Fire Prevention System for preventing bush and forest fires from engulfing a building by automatically soaking the building with water after a fire has been detected. The inventive device includes a central processing unit (CPU), a plurality of heat sensors, a solenoid powered control valve connected to a water main, a distribution pipe connected to the control valve and a plurality of sprinklers connected to the distribution pipe. The sprinklers direct water towards the building and towards the ground surrounding the building.

5 Claims, 3 Drawing Sheets

BUILDING EXTERIOR FIRE PREVENTION SYSTEM

BACKGROUND OF THE INVENTION

1. Field of the Invention

The present invention relates to Fire Extinguishing Devices and more particularly pertains to a new Building Exterior Fire Prevention System for preventing bush and forest fires from engulfing a building by automatically soaking the building with water after a fire has been detected.

2. Description of the Prior Art

The use of Fire Extinguishing Devices is known in the prior art. More specifically, Fire Extinguishing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Fire Extinguishing Devices include U.S. Pat. No. 5,083,618; U.S. Pat. No. 5,125,458; U.S. Pat. No. 4,991,657; U.S. Pat. No. 5,298,223; U.S. Pat. No. 5,311,167 and U.S. Des. Pat. No. 346,981.

While these devices fulfill their respective, particular objectives and requirements, the aforementioned patents do not disclose a new Building Exterior Fire Prevention System. The inventive device includes a central processing unit (CPU), a plurality of heat sensors, a solenoid powered control valve connected to a water main, a distribution pipe connected to the control valve and a plurality of sprinklers connected to the distribution pipe.

In these respects, the Building Exterior Fire Prevention System according to the present invention substantially departs from the conventional concepts and designs of the prior art, and in so doing provides an apparatus primarily developed for the purpose of preventing bush and forest fires from engulfing a building by automatically soaking the building with water after a fire has been detected.

SUMMARY OF THE INVENTION

In view of the foregoing disadvantages inherent in the known types of Fire Extinguishing Devices now present in the prior art, the present invention provides a new Building Exterior Fire Prevention System construction wherein the same can be utilized for preventing bush and forest fires from engulfing a building by automatically soaking the building with water after a fire has been detected.

The general purpose of the present invention, which will be described subsequently in greater detail, is to provide a new Building Exterior Fire Prevention System apparatus and method which has many of the advantages of the Fire Extinguishing Devices mentioned heretofore and many novel features that result in a new Building Exterior Fire Prevention System which is not anticipated, rendered obvious, suggested, or even implied by any of the prior art Fire Extinguishing Devices, either alone or in any combination thereof.

To attain this, the present invention generally comprises a central processing unit (CPU), a plurality of heat sensors, a solenoid powered control valve connected to a water main, a distribution pipe connected to the control valve and a plurality of sprinklers connected to the distribution pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Building Exterior Fire Prevention System apparatus and method which has many of the advantages of the Fire Extinguishing Devices mentioned heretofore and many novel features that result in a new Building Exterior Fire Prevention System which is not anticipated, rendered obvious, suggested, or even implied by any of the prior art Fire Extinguishing Devices, either alone or in any combination thereof.

It is another object of the present invention to provide a new Building Exterior Fire Prevention System which may be easily and efficiently manufactured and marketed.

It is a further object of the present invention to provide a new Building Exterior Fire Prevention System which is of a durable and reliable construction.

An even further object of the present invention is to provide a new Building Exterior Fire Prevention System which is susceptible of a low cost of manufacture with regard to both materials and labor, and which accordingly is then susceptible of low prices of sale to the consuming public, thereby making such Building Exterior Fire Prevention System economically available to the buying public.

Still yet another object of the present invention is to provide a new Building Exterior Fire Prevention System which provides in the apparatuses and methods of the prior art some of the advantages thereof, while simultaneously overcoming some of the disadvantages normally associated therewith.

Still another object of the present invention is to provide a new Building Exterior Fire Prevention System for preventing bush and forest fires from engulfing a building by automatically soaking the building with water after a fire has been detected.

Yet another object of the present invention is to provide a new Building Exterior Fire Prevention System which includes a central processing unit (CPU), a plurality of heat sensors, a solenoid powered control valve connected to a water main, a distribution pipe connected to the control valve and a plurality of sprinklers connected to the distribution pipe.

Still yet another object of the present invention is to provide a new Building Exterior Fire Prevention System that prevents a building from becoming engulfed by a nearby building fire.

Even still another object of the present invention is to provide a new Building Exterior Fire Prevention System that automatically protects a dwelling against an advancing bush or forest fire by continuously soaking a flammable roof and walls with water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
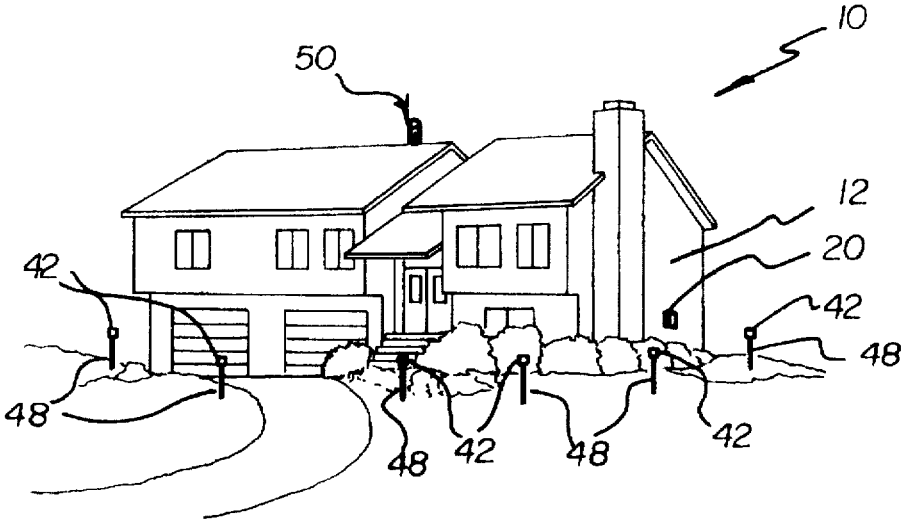
FIG. 1 is an upper perspective view of a new Building Exterior Fire Prevention System according to the present invention.
Figure 2:
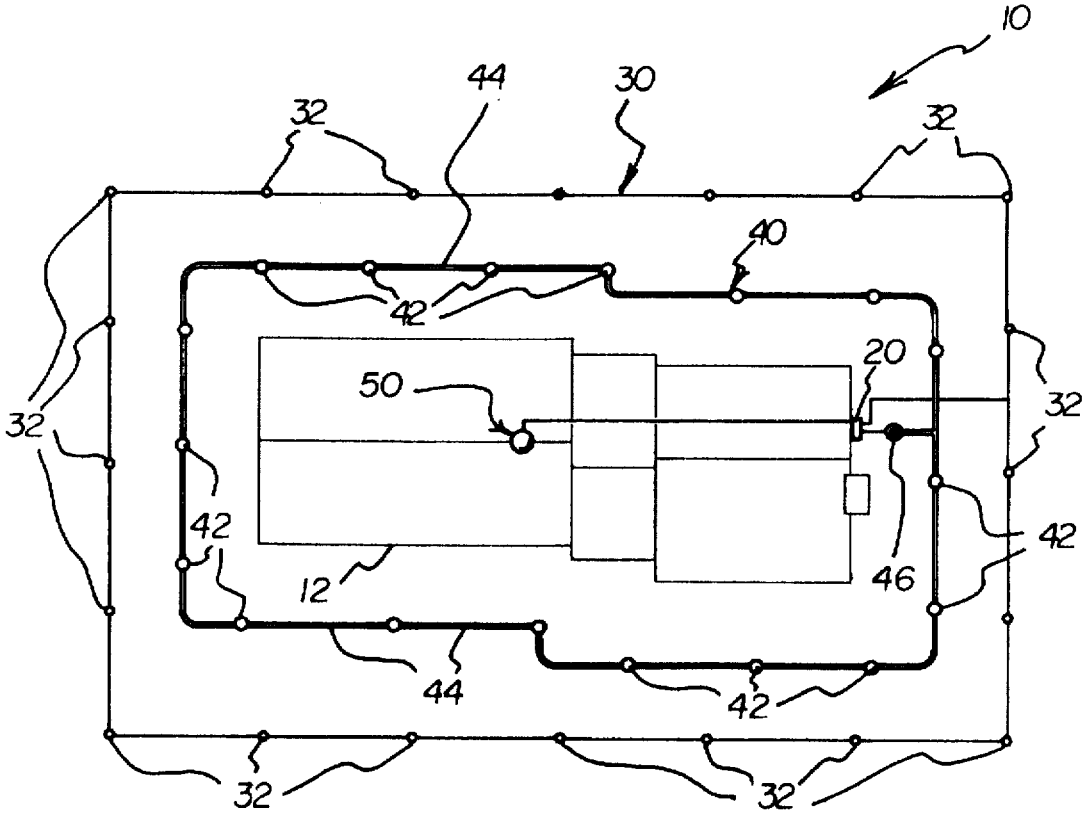
FIG. 2 is a top view of the present invention.
Figure 3:
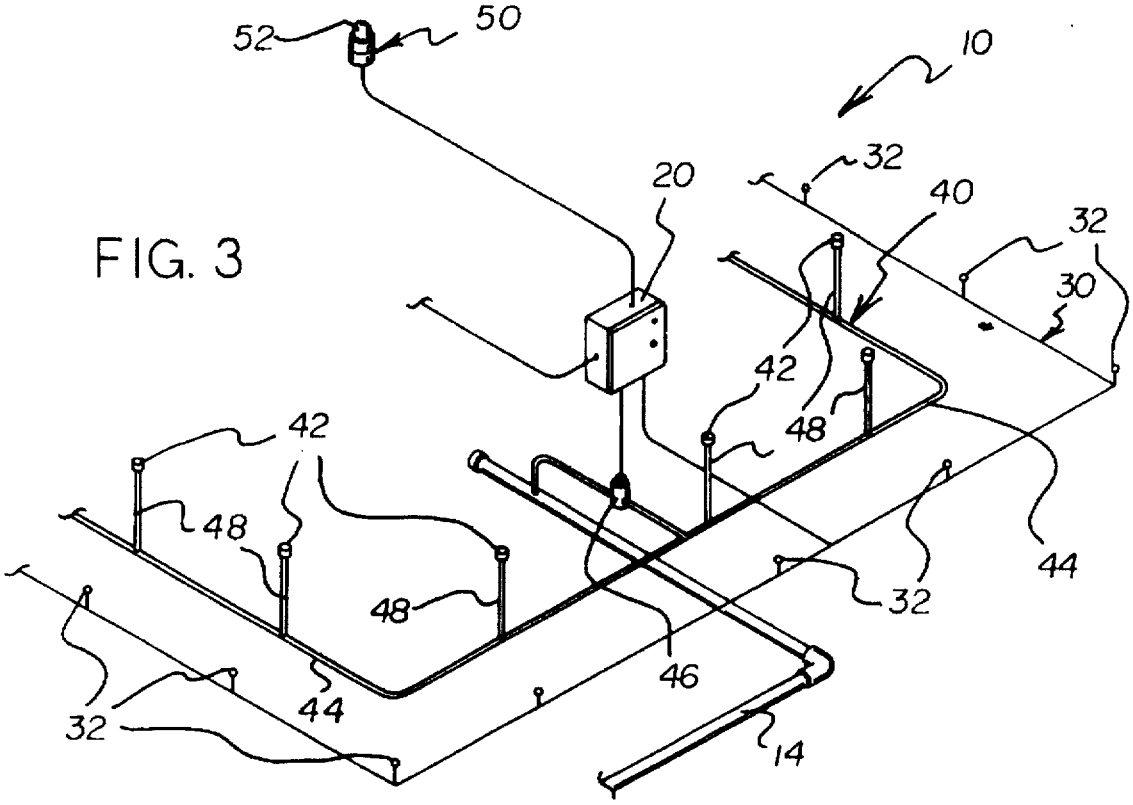
FIG. 3 is an upper side perspective view of the present invention.
Figure 4:
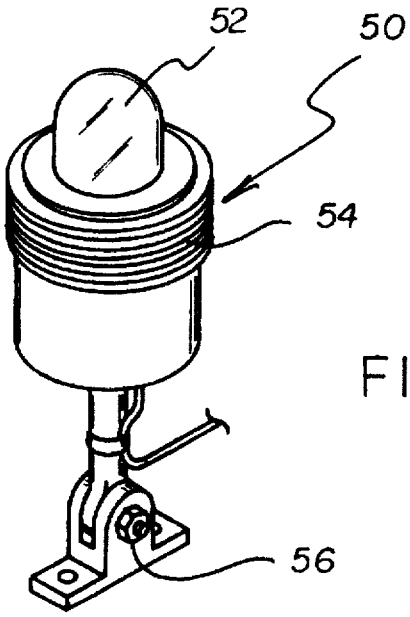
FIG. 4 is a magnified upper perspective view of the warning means.
Figure 5:
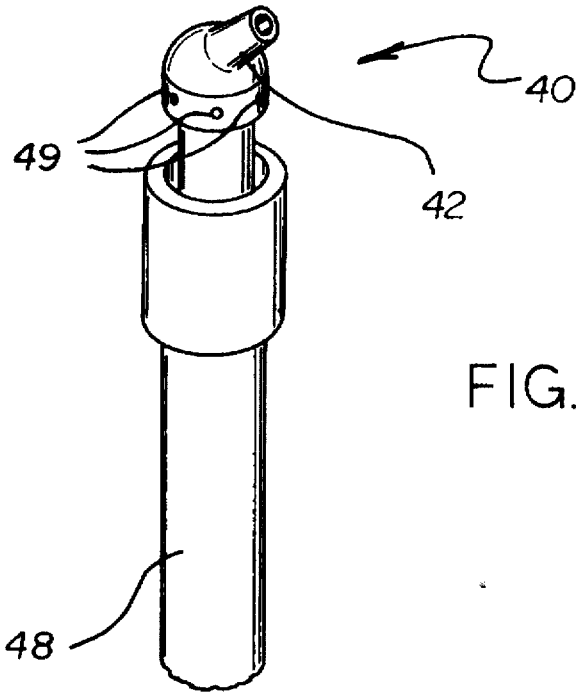
FIG. 5 is a magnified upper perspective view of the water dispensing means.
Figure 6:
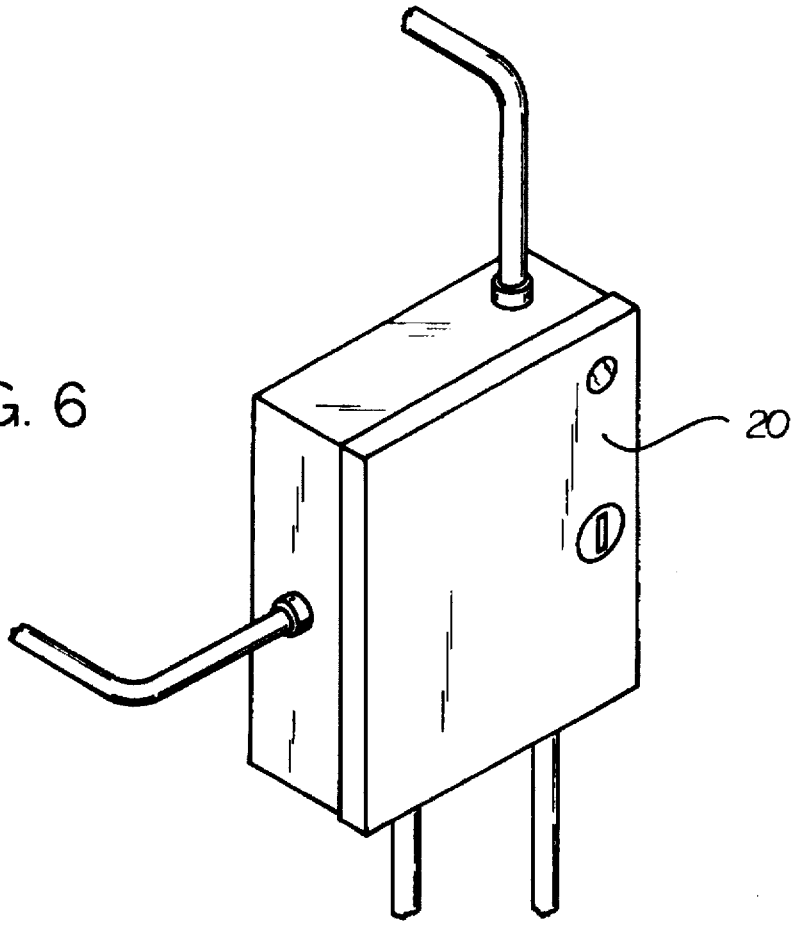
FIG. 6 is a magnified upper perspective view of the central processing unit.

With reference now to the drawings, and in particular to FIGS. 1 through 6 thereof, a new Building Exterior Fire Prevention System embodying the principles and concepts of the present invention and generally designated by the reference numeral 10 will be described.

More specifically, it will be noted that the Building Exterior Fire Prevention System 10 comprises a central processing unit 20, a fire detecting means 30 surrounding a building 12 and electrically coupled to the central processing unit 20 for detecting a fire near the building 12, and a water dispensing means 40 surrounding the building 12 and electrically coupled to the central processing unit 20 for dispensing a large volume of water onto and around the building 12 to prevent the building 12 from being engulfed from the fire.

As best illustrated in FIGS. 1 through 4, it can be shown that a warning means 50 is secured on a roof of the building 12. The warning means 50 is electrically coupled to the central processing unit 20 for radiating a bright light and a warning sound when the fire is detected by the fire detecting means 30. The warning means 50 comprises a strobe light 52 electrically coupled to the central processing unit 20 for flashing the bright light. A siren 54 is connected to the strobe light 52 and electrically coupled to the central processing unit 20 for emitting the warning sound. An adjustable mounting bracket 56 is secured to the siren 54 for securing the siren 54 and the strobe light 52 to the roof of the building 12. The fire detecting means 30 comprises a plurality of heat sensors 32 within the ground and electrically coupled to the central processing unit 20 for detecting the fire.

As best shown in FIGS. 1 through 6 of the drawings, the water dispensing means 40 comprises a solenoid powered control valve 46 connected to a water main 14. The control valve 46 is electrically coupled to the central processing unit 20, wherein the central processing unit 20 controls the control valve 46 which is normally closed. A distribution pipe 44 is connected to the control valve 46 opposite of the water main 14. The distribution pipe 44 is preferably positioned under ground around the building 12. A plurality of vertical pipes 48 distally spaced are connected to the distribution pipe 44 projecting a finite distance above the ground. A corresponding plurality of pop-up directional sprinklers 42 are connected onto the vertical pipes 48 opposite of the distribution pipe 44 for directing water directly at the building 12 when the fire is detected. A plurality of radial apertures 49 project into the pop-up directional sprinkler 42 for dispensing water radially about the pop-up directional sprinkler 42 for soaking the ground around the building 12.

In use, the fire detecting means 30 detects a fire near the building 12. The fire detecting means 30 communicates with the central processing unit 20 which opens the control valve 46. The central processing unit 20 communicates with the warning means 50 which emits a bright light and warning sound. Water thereafter flows through the distribution pipe 44 through the vertical pipes 48. The water then flows out through the pop-up directional sprinkler 42 towards the building 12 and radially towards the surrounding ground to prevent the fire from engulfing the building 12. This continues until a person turns off the central processing unit 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A Building Exterior Fire Prevention System comprising a central processing unit;

a fire detecting means surrounding a building and electrically coupled to said central processing unit for detecting a fire near said building;

a water dispensing means surrounding said building and electrically coupled to said central processing unit for dispensing a large volume of water onto and around said building to prevent said building from being engulfed from said fire; and a warning means secured on a roof of said building and electrically coupled to said central processing unit for radiating a bright light and a warning sound when said fire is detected by said fire detecting means.

2. The Building Exterior Fire Prevention System of claim 1, wherein said water dispensing means comprises:

a solenoid powered control valve connected to a water main and electrically coupled to said central processing unit, wherein said central processing unit controls said control valve which is normally closed;

a distribution pipe connected to said control valve opposite of said water main, wherein said distribution pipe is positioned under ground around said building;

a plurality of vertical pipes distally spaced are connected to said distribution pipe projecting a finite distance above said ground; and a corresponding plurality of pop-up directional sprinklers connected onto said vertical pipes opposite of said distribution pipe for directing water directly at said building when said fire is detected.

3. The Building Exterior Fire Prevention System of claim 2, wherein a plurality of radial apertures project into said pop-up directional sprinkler for dispensing water radially about said pop-up directional sprinkler for soaking said ground around said building.

4. The Building Exterior Fire Prevention System of claim 1, wherein said warning means comprises:

a strobe light electrically coupled to said central processing unit for flashing said bright light;

a siren connected to said strobe light and electrically coupled to said central processing unit for emitting said warning sound; and an adjustable mounting bracket secured to said siren for securing said siren and said strobe light to said roof of said building.

5. The Building Exterior Fire Prevention System of claim 1, wherein said fire detecting means comprises a plurality of heat sensors within said ground and electrically coupled to said central processing unit for detecting said fire.

* * * * *